US009759031B2

(12) United States Patent
Bakri et al.

(10) Patent No.: US 9,759,031 B2
(45) Date of Patent: Sep. 12, 2017

(54) FREEING PIPE STUCK IN A SUBTERRANEAN WELL

(75) Inventors: Emad Bakri, Houston, TX (US); Malcolm E. Whittaker, Houston, TX (US); Neal G. Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 281 days.

(21) Appl. No.: 14/366,067

(22) PCT Filed: Aug. 22, 2012

(86) PCT No.: PCT/US2012/051930
§ 371 (c)(1),
(2), (4) Date: Dec. 23, 2014

(87) PCT Pub. No.: WO2014/031116
PCT Pub. Date: Feb. 27, 2014

(65) Prior Publication Data

US 2015/0176356 A1 Jun. 25, 2015

(51) Int. Cl.
*E21B 29/02* (2006.01)
*E21B 29/06* (2006.01)
(Continued)

(52) U.S. Cl.
CPC ..... *E21B 31/00* (2013.01); *E21B 7/24* (2013.01); *E21B 31/20* (2013.01); *E21B 33/124* (2013.01);
(Continued)

(58) Field of Classification Search
CPC ..... E21B 31/002; E21B 29/02; E21B 29/06; E21B 47/09; E21B 31/03; E21B 31/00
See application file for complete search history.

(56) References Cited

U.S. PATENT DOCUMENTS 2,746,550 A * 5/1956 Mitchell, Jr. ..... E21B 19/00 166/255.1
3,246,696 A * 4/1966 Fox, Jr. ..... E21B 31/03 166/301
(Continued)

FOREIGN PATENT DOCUMENTS

EP 2194228 A1 6/2010

OTHER PUBLICATIONS

International Search Report with Written Opinion issued Mar. 18, 2013 for PCT Patent Application No. PCT/US12/051930, 11 pages.
(Continued)

*Primary Examiner* — Kipp Wallace
(74) *Attorney, Agent, or Firm* — Chamberlain Hrdlicka

(57) ABSTRACT

A method of freeing a pipe stuck in a subterranean well can include determining a location of a portion of the pipe stuck in the well, and penetrating and/or heating a sidewall of the pipe portion with a beam of light. A system for freeing a pipe stuck in a subterranean well can include a tool deployed into a portion of the pipe stuck in the well by a differential pressure from a wellbore to a formation penetrated by the wellbore. A beam of light emitted from the tool penetrates the pipe portion. Another method of freeing a pipe stuck in a subterranean well can include determining a location of a portion of the pipe which is biased against a wall of a wellbore by differential pressure, and directing a beam of light to the pipe portion.

33 Claims, 6 Drawing Sheets

(51) Int. Cl.

| | |
|---|---|
| ***E21B 31/00*** | (2006.01) |
| ***E21B 7/24*** | (2006.01) |
| ***E21B 31/20*** | (2006.01) |
| ***E21B 47/04*** | (2012.01) |
| ***E21B 47/09*** | (2012.01) |
| ***E21B 47/10*** | (2012.01) |
| ***E21B 33/124*** | (2006.01) |

(52) U.S. Cl.
CPC ..... *E21B 47/04* (2013.01); *E21B 47/09* (2013.01); *E21B 47/091* (2013.01); *E21B 47/102* (2013.01)

(56) References Cited

U.S. PATENT DOCUMENTS

| | | | | |
|---|---|---|---|---|
| 3,268,003 | A | 8/1966 | Essary | |
| 3,404,563 | A | 10/1968 | Davis et al. | |
| 4,125,013 | A * | 11/1978 | Nicolas | E21B 23/01 73/152.56 |
| 4,448,250 | A | 5/1984 | Cooke et al. | |
| 5,509,480 | A * | 4/1996 | Terrell | E21B 43/114 102/275.11 |
| 6,148,917 | A | 11/2000 | Brookey et al. | |
| 2003/0070812 | A1 * | 4/2003 | Robertson | E21B 29/02 166/298 |
| 2004/0216880 | A1 | 11/2004 | Tutuncu et al. | |
| 2008/0115941 | A1 | 5/2008 | Elder | |
| 2008/0166132 | A1 | 7/2008 | Lynde et al. | |
| 2009/0166035 | A1 * | 7/2009 | Almaguer | E21B 7/061 166/254.1 |
| 2010/0326659 | A1 | 12/2010 | Schultz et al. | |
| 2013/0228372 | A1 * | 9/2013 | Linyaev | E21B 7/15 175/16 |

OTHER PUBLICATIONS

Halliburton Energy Services, Inc.; "The Fast Circumferential Acoustic Scanning Tool", Article H04486, dated Jan. 2008, 2 pages.
Halliburton Energy Services, Inc.; "Radial Cement Bond Log (RCBL)" Article H05968, dated Mar. 2008, 2 pages.
Halliburton Energy Services, Inc.; "CAST-M", Article H07673, dated Apr. 2011, 2 pages.
Society of Petroleum Engineers; "Formation Pressure While Drilling Utilized for Geosteering", SPE paper No. 110940, dated May 7-8, 2007, 6 pages.

* cited by examiner

FREEING PIPE STUCK IN A SUBTERRANEAN WELL

CROSS-REFERENCE TO RELATED APPLICATION

This application is a national stage under 35 USC 371 of International Application No. PCT/US12/51930, filed on 22 Aug. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a way of freeing pipe stuck in a well.

BACKGROUND

Tubular strings can become stuck in wells due to a variety of causes. One cause is differential pressure, with fluid pressure in a wellbore being greater than pressure in a surrounding earth formation. If a tubular string, such as drill pipe, is pressed against a wall of the wellbore, so that the differential pressure from the wellbore to the formation acts on the tubular string, it can be very difficult to move the tubular string away from the wall of the wellbore, so that the tubular string can be freed. This is known to those skilled in the art as differential sticking.

It will, thus, be readily appreciated that improvements are continually needed in the art of freeing pipe stuck in a well.

DETAILED DESCRIPTION

Figure 1:
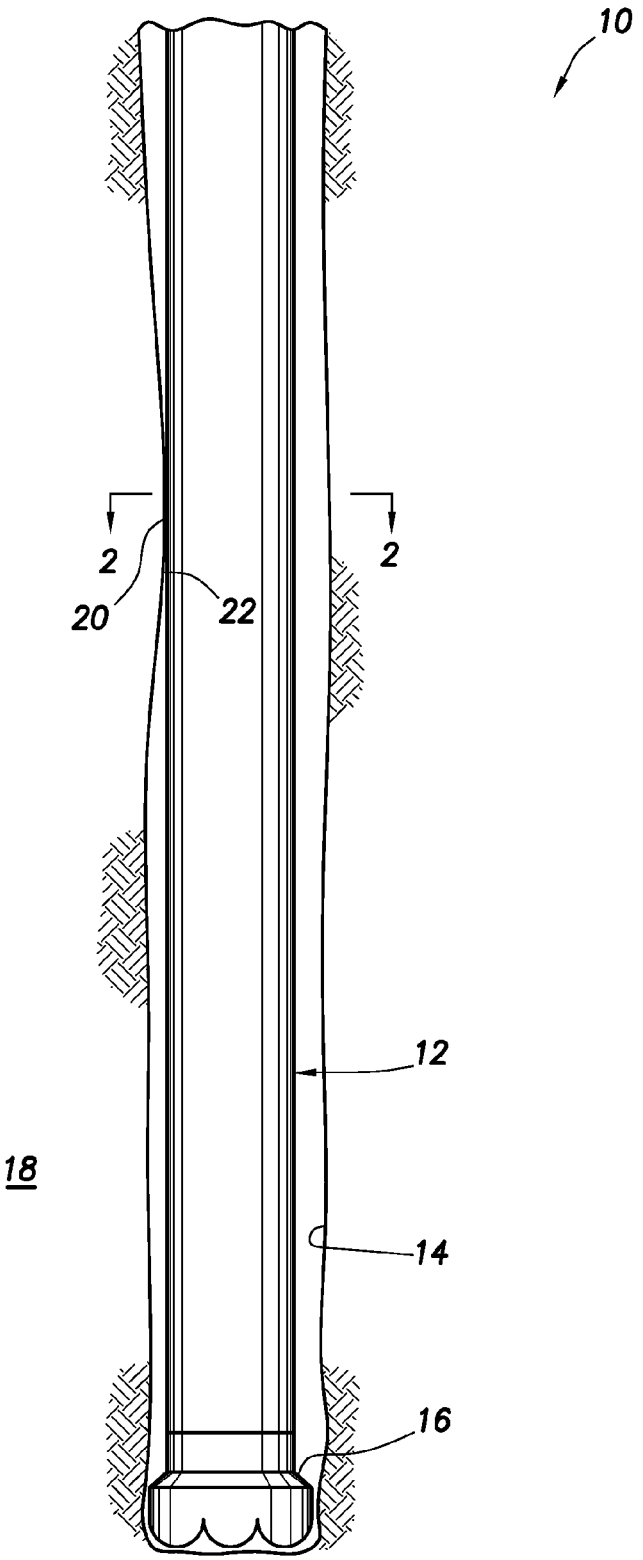
FIG. 1 is a representative partially cross-sectional view of a well system and associated method which can embody principles of this disclosure.

Representatively illustrated in FIG. 1 is a system 10 and an associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a pipe 12 is positioned in a wellbore 14. The term "pipe" is used herein to indicate any of a variety of different tubulars, such as, those tubulars known to those skilled in the art as drill pipe, liner, casing, production tubing, etc.

As depicted in FIG. 1, the pipe 12 comprises drill pipe. A drill bit 16 is connected at a distal end of the pipe 12 for drilling the wellbore 14, so that the wellbore penetrates an earth formation 18.

Unfortunately, a portion 20 of the pipe 12 can become stuck against a wall 22 of the wellbore 14. This can make it difficult (if not virtually impossible) to retrieve the pipe from the wellbore 14 with conventional rig equipment.

Figure 2:
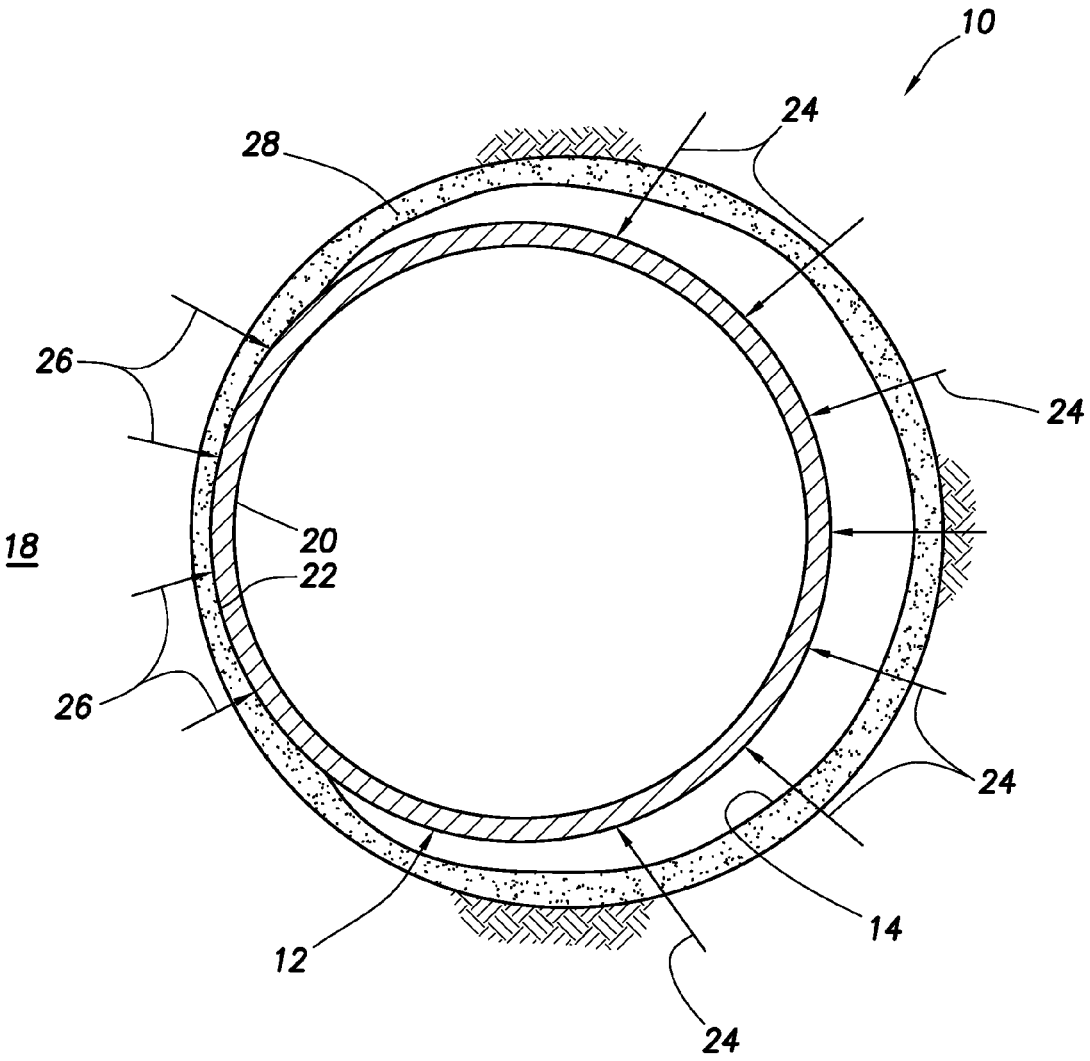
FIG. 2 is a representative cross-sectional view of the system and method, taken along line 2-2 of FIG. 1.

Referring additionally now to FIG. 2, an enlarged scale cross-sectional view of the system 10 is representatively illustrated. In this view, it may be seen that pressure 24 in the wellbore 14 is greater than pressure 26 in the formation 18, and so a resulting differential pressure biases the pipe 12 against the wall 22 of the wellbore.

In the FIG. 2 example, this problem is exacerbated by the presence of a mud cake 28 lining the wellbore 14. The pipe 12 can become embedded in the mud cake 28 (for example, due to lack of movement of the pipe for an extended period of time, etc.), and the mud cake can at least partially seal against the pipe, so that the pressure differential is exerted across the pipe. This causes the pipe portion 20 to be pressed tightly against the wellbore wall 22, resisting attempts to displace the pipe 12 with conventional rig equipment.

This condition is known to those skilled in the art as differential sticking. However, it should be clearly understood that it is not necessary for the pipe 12 to be embedded in the mud cake 28, or for differential sticking to occur, in order to utilize the principles of this disclosure. The pipe 12 could become stuck due to other conditions (for example, wellbore cave-in, etc.).

Figure 3:
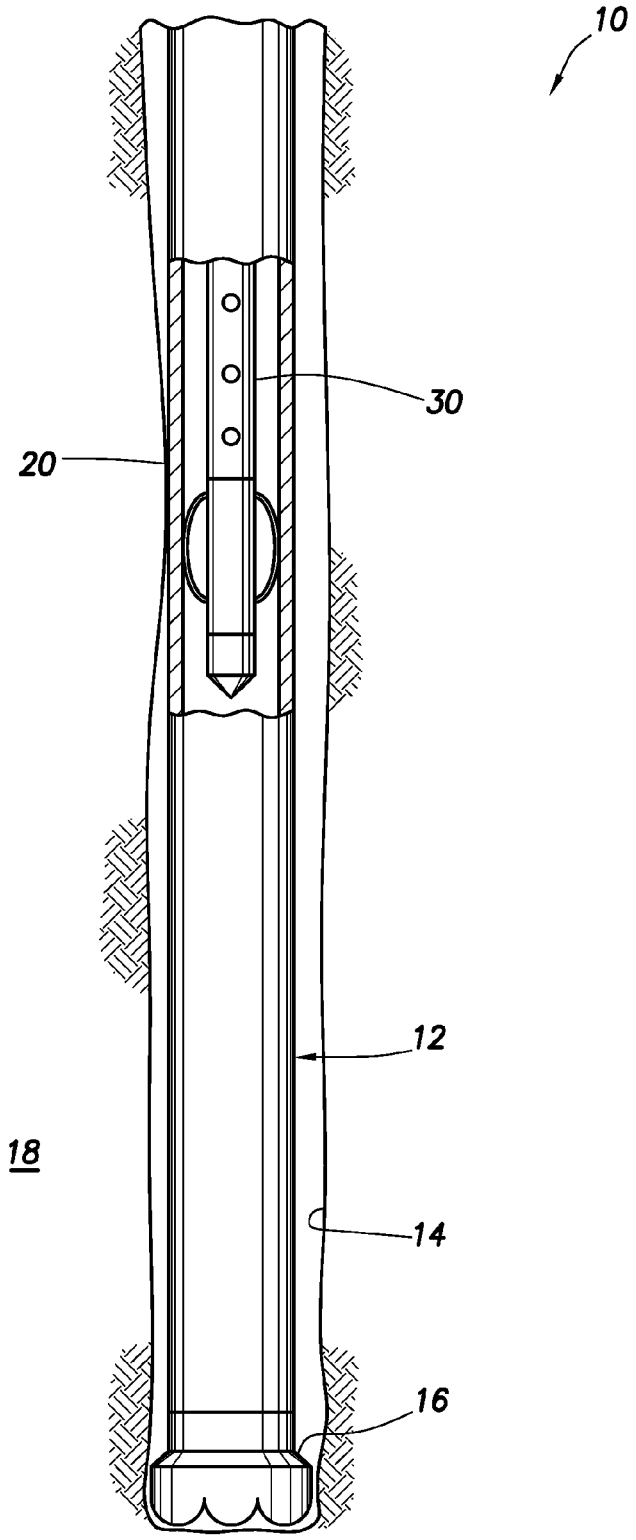
FIG. 3 is a representative partially cross-sectional view of the system and method, wherein a location of a stuck portion of a pipe is determined.

Referring additionally now to FIG. 3, a cross-sectional view of the system 10 is representatively illustrated, in which a tool 30 is conveyed into the pipe 12, in order to determine a location of the stuck pipe portion 20. The tool 30 preferably uses acoustic signals to locate the stuck pipe portion 20, although other types of tools may be used, if desired.

In the FIG. 3 example, the tool 30 transmits acoustic signals to the pipe 12, and receives reflections of the acoustic signals. As will be appreciated by those skilled in the art, a portion the pipe 12 will "ring" more if it is not stuck, and will "ring" less if it is stuck.

The tool 30 may be similar to acoustic cement bond logging tools used to evaluate cement placement and integrity, in which case an image (possibly three-dimensional) representing acoustic characteristics of the stuck pipe portion 20 may be obtained. Preferably, the tool 30 is capable of determining a depth, as well as an azimuthal orientation, of the stuck pipe portion 20.

Suitable conventional cement bond logging tools include the FASTCAST™, RCBL™ and CAST-M™ tools marketed by Halliburton Energy Services, Inc. of Houston, Tex. USA. Such tools may be conveyed by wireline, coiled tubing or any other type of conveyance.

However, note that it is not necessary for acoustic signals to be used to locate the stuck pipe portion 20. Other types of logging tools, and other techniques for locating the stuck pipe portion 20, may be used without departing from the scope of this disclosure.

Figure 4:
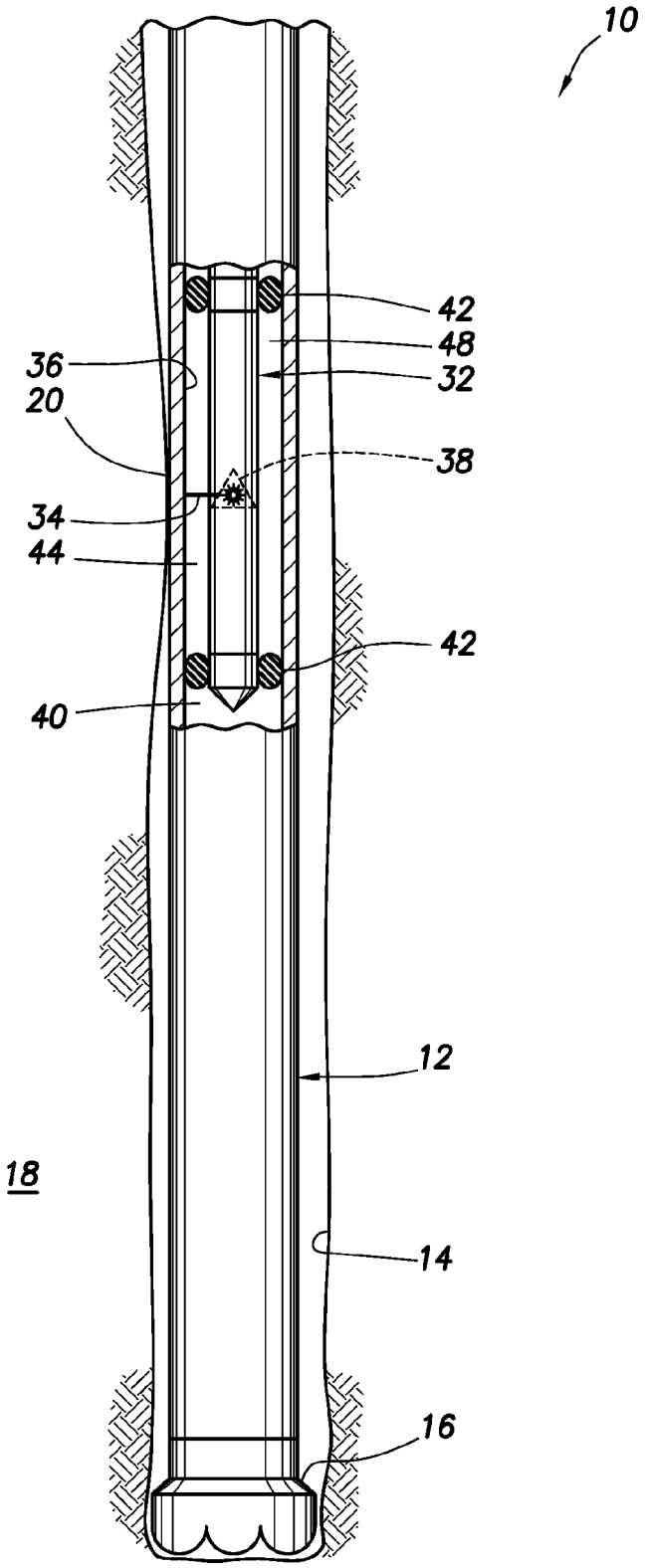
FIG. 4 is a representative partially cross-sectional view of the system and method, wherein a beam of light penetrates a sidewall of the pipe to mitigate the stuck condition.

Referring additionally now to FIG. 4, another representative cross-sectional view of the system 10 is illustrated, in which another tool 32 is deployed into the pipe 12. The tool 32 may be conveyed by wireline, coiled tubing or any other suitable conveyance. The tool 32 is positioned adjacent the stuck pipe portion 20, and is azimuthally oriented, so that a beam of light 34 emitted laterally from the tool is directed to the stuck pipe portion.

Preferably, the beam of light 34 has sufficient intensity to cut through a sidewall 36 of the pipe 20. For this purpose, a laser 38 may be used to produce the beam of light 34. The laser 38 is depicted in FIG. 4 as being contained in the tool 32, but in other examples the laser could be remotely positioned, as described more fully below.

If the laser 38 is positioned downhole, as in the FIG. 4 example, a 2-3 kW ytterbium doped fiber laser with an emission wavelength of 1070 nm would be suitable. If the laser 38 is remotely positioned, as in the FIG. 6 example described below, a 6-9 kW ytterbium doped laser, or a 4-6 kW erbium doped laser with an emission wavelength of 1550 nm, would be suitable. The power output requirements for the laser 38 will vary, depending on a size of openings to be formed through the sidewall 36, an amount of time allotted for cutting each opening, etc.

Other types of lasers or other optical sources may be used, in keeping with the scope of this disclosure. Penetration of tubular string sidewalls using optical laser power for establishing communication with earth formations is described in US application publication no. 2010/0326659. However, note that the scope of this disclosure is not limited to techniques in which a tubular string sidewall is penetrated by a beam of light, since in other examples the beam of light could be used to heat the tubular string sidewall without penetrating it.

In order to mitigate attenuation of the beam of light 34 by well fluid 40 external to the tool 32, the well fluid may be purged from an annulus 48 longitudinally between two seals 42 carried on the tool. For example, a relatively optically clear fluid 44 may be used to displace the well fluid 40 from longitudinally between the seals 42, and from radially between the tool 32 and the stuck pipe portion 20. Purging of well fluid from about a laser perforating tool is described in US application publication no. 2012/0118568.

Figure 5:
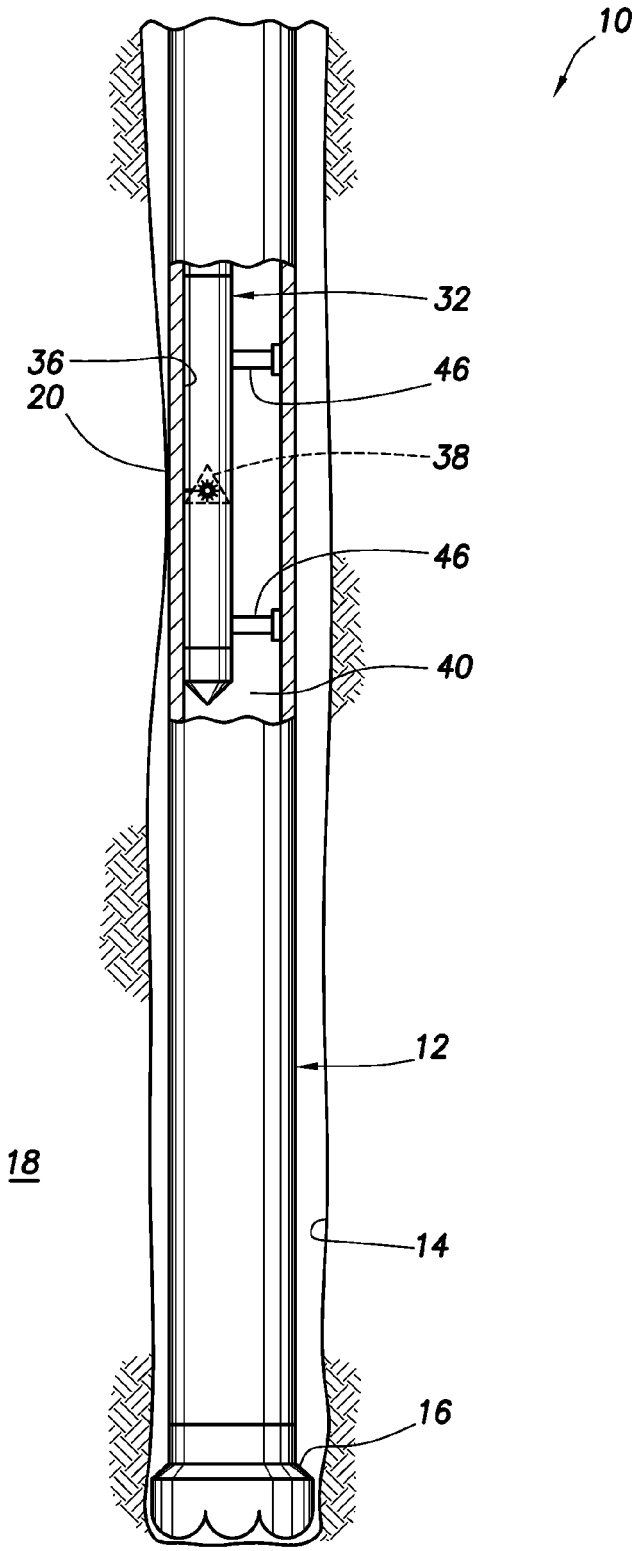
FIG. 5 is a representative partially cross-sectional view of the system and method, showing another example of a beam of light penetrating the sidewall of the pipe to mitigate the stuck condition.

Referring additionally now to FIG. 5, another example of the system 10 is representatively illustrated, in which another technique for mitigating attenuation of the beam of light 34 is utilized. In the FIG. 5 example, the tool 32 does not include the seals 42. Instead, the tool 32 is pressed against the sidewall 36 by means of laterally extendable arms 46.

By pressing the tool 32 against (or at least toward) the sidewall 36, the beam of light 34 traverses significantly less (or none) of the well fluid 40 between the tool and the sidewall, thereby minimizing any resulting attenuation. In addition, spreading of the beam of light 34 can be reduced by decreasing a distance between the tool 32 and the sidewall 36.

Figure 6:
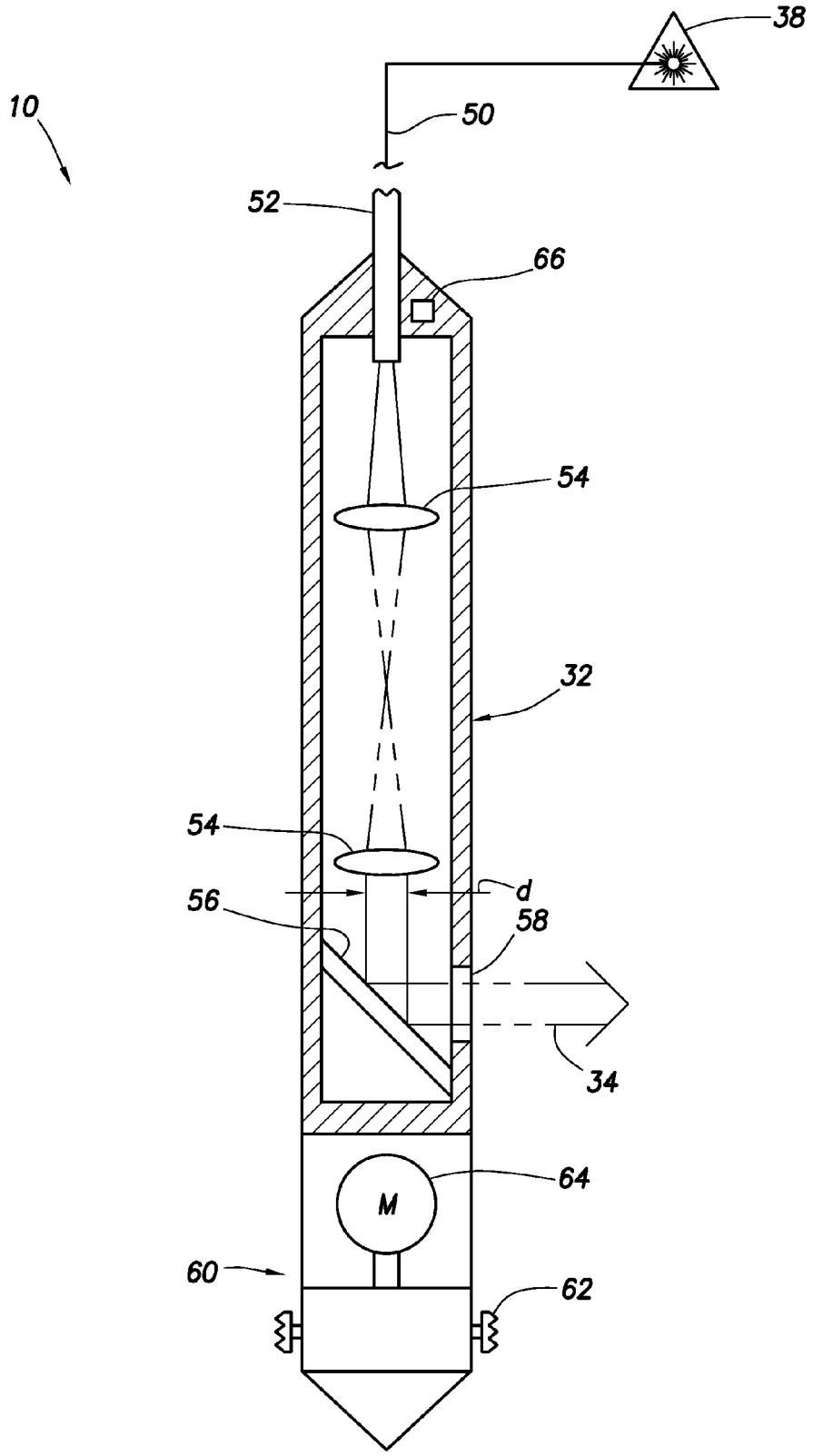
FIG. 6 is a partially cross-sectional view of a tool assembly which may be used to penetrate or at least heat the pipe sidewall with the beam of light.

Referring additionally now to FIG. 6, another example of the system 10 is representatively illustrated, in which the laser 38 is positioned at a remote location (such as, at or near the earth's surface, a sea floor facility, a floating rig, etc.). Light produced by the laser 38 is transmitted to the tool 32 via an optical waveguide 50 (such as, an optical fiber, optical ribbon, etc.), which may be a component of an optical cable 52 connected to the tool 32 and used to convey the tool into the well.

Suitable lenses 54 may be positioned and spaced apart in the tool 32 for focusing the light transmitted via the cable 52, so that the beam of light 34 has a desired diameter d for penetrating the pipe sidewall 36. A reflector 56 (such as, a mirror, etc.) can be used to direct the beam of light 34 laterally outward via an optically clear window 58 in a side of the tool 32.

An azimuthal orientation device 60 can be provided as part of the tool 32 for orienting the window 58 (and, thus, the beam of light 34) toward the stuck pipe portion 20. In the FIG. 6 example, the orientation device 60 includes an anchor 62 for gripping an interior surface of the pipe 12, and a motor 64 for rotating the remainder of the tool 32 relative to the anchor. An azimuthal orientation sensor 66 senses the azimuthal orientation of the tool 32.

In practice, when it is determined that the pipe 12 has become stuck in the wellbore 14, the logging/survey tool 30 is deployed into the pipe to determine the location of the stuck portion 20 of the pipe. Preferably, not only the depth, but also the azimuthal orientation of the stuck pipe portion 20, are determined using the tool 30.

The tool 30 is retrieved from the pipe 12, and the laser remediation tool 32 is then deployed into the pipe. The tool 32 is positioned at the location of the stuck pipe portion 20, and (in one example) the window 58 is azimuthally oriented toward the stuck pipe portion using the azimuthal orientation device 60.

The beam of light 34 is then produced by the laser 38, and is directed toward the stuck pipe portion 20. In one example, the beam of light 34 has sufficient intensity to penetrate completely through the pipe sidewall 36, and at least partially into the mud cake 28. The tool 32 may be repositioned as desired to cut multiple openings through the pipe sidewall 36, thereby perforating the stuck pipe portion 20 and preventing the differential pressure from acting across the stuck pipe portion.

In some examples, the beam of light 34 can also disintegrate or otherwise disturb the mud cake 28 adjacent the pipe sidewall 36, thereby preventing the mud cake from sealing against the sidewall. In other examples, the beam of light 34 can heat the pipe sidewall 36, without penetrating through it. This heating can increase the formation pressure 26 locally, and/or reduce a viscosity of the mud cake 28, so that the portion 20 can be pulled away from the wellbore wall 22.

The tool 32 can then be retrieved from the pipe 12, and the pipe can be retrieved from the well.

Although the survey/logging tool 30 and the laser remediation tool 32 are described above as being separate tools, which are separately deployed into the pipe 12, it will be appreciated that these tools could be combined into a single tool assembly, and could be deployed together into the pipe.

It may now be fully appreciated that the above disclosure provides significant advancements to the art of freeing pipe stuck in a wellbore. In examples described above, the laser remediation tool 32 can be used to penetrate, or at least heat, the sidewall 36 of the stuck pipe portion 20, allowing the pipe 12 to be conveniently retrieved from the well.

A method of freeing a pipe 12 stuck in a subterranean well is provided to the art by the above disclosure. In one example, the method can comprise determining a location of a portion 20 of the pipe 12 stuck in the well; and penetrating and/or heating a sidewall 36 of the pipe portion 20 with a beam of light 34.

The determining step can include determining the location at which the portion 20 of the pipe 12 is biased against a wall 22 of a wellbore 14 by differential pressure.

The determining step can include transmitting an acoustic signal to the pipe 12.

The determining step can include determining an azimuthal orientation of the pipe portion 20.

The penetrating step can include producing the beam of light 34 from a laser 38.

The method can include positioning the laser 38 in a tool 32, and deploying the tool 32 into the pipe 12. The method can further include azimuthally aligning the tool 32 with the pipe portion 20. The method can include transmitting the beam of light 34 from the laser 38 and into the pipe 12 via an optical waveguide 50.

The stuck pipe portion 20 may be embedded in a mud cake 28 lining a wellbore 14. The penetrating step can include cutting into the mud cake 28. The heating step can include reducing a viscosity of the mud cake 28 and/or increasing a pressure 26 external to the pipe 12.

The penetrating step can include emitting the beam of light 34 from a tool 32 positioned in the well, after purging well fluid 40 from between the tool 32 and the pipe portion 20.

A system 10 for freeing a pipe 12 stuck in a subterranean well is also described above. In one example, the system 10 can include a tool 32 deployed into a portion 20 of the pipe 12 stuck in the well by differential pressure from a wellbore 14 to a formation 18 penetrated by the wellbore 14. A beam of light 34 emitted from the tool 32 heats and/or penetrates the pipe portion 20.

A laser 38 may be positioned in the tool 32. The tool 32 may include an azimuthal orientation device 60.

The system 10 can include a laser 38 positioned remote from the tool 32, with the beam of light 34 being transmitted from the laser 38 to the tool 32 via an optical waveguide 50.

The pipe portion 20 may be embedded in a mud cake 28 lining the wellbore 14. The beam of light 34 may at least partially penetrate the mud cake 28.

The tool 32 can include seals 42 which straddle the pipe portion 20. Well fluid 40 may be purged from radially between the tool 32 and the pipe portion 20, and from longitudinally between the seals 42.

Another method of freeing a pipe 12 stuck in a subterranean well can comprise: determining a location of a portion 20 of the pipe 12 which is biased against a wall 22 of a wellbore 14 by differential pressure; and directing a beam of light 34 to the pipe portion 20.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of freeing a pipe stuck in a subterranean well, the method comprising:

determining an axial and azimuthal location of a portion of the pipe stuck in the well;

azimuthally and axially aligning a tool with the axial and azimuthal location of the pipe portion; and penetrating a sidewall of the pipe portion with a beam of light at the axial and azimuthal location of the pipe portion to heat the sidewall of the pipe portion, thereby reducing a viscosity of a mud cake external to the pipe portion and/or increasing a pressure external to the pipe portion to allow the pipe to be retrieved from the well.

2. The method of claim 1, wherein the determining further comprises determining the location at which the portion of the pipe is biased against a wall of a wellbore by differential pressure.

3. The method of claim 1, wherein the determining further comprises transmitting an acoustic signal to the pipe.

4. The method of claim 1, wherein the penetrating further comprises producing the beam of light from a laser.

5. The method of claim 4, further comprising positioning the laser in the tool, and deploying the tool into the pipe.

6. The method of claim 4, further comprising transmitting the beam of light from the laser and into the pipe via an optical waveguide.

7. The method of claim 1, wherein the pipe portion is embedded in the mud cake lining a wellbore.

8. The method of claim 7, wherein the penetrating further comprises cutting into the mud cake.

9. The method of claim 1, wherein the penetrating further comprises emitting the beam of light from the tool positioned in the well, after purging well fluid from between the tool and the pipe portion.

10. A system for freeing a pipe stuck in a subterranean well, the system comprising:

a tool configured to be deployed into an axial and azimuthal location portion of the pipe stuck in the well by a differential pressure from a wellbore to a formation penetrated by the wellbore, wherein the tool is configured to emit a beam of light from the tool to penetrate the axial and azimuthal location of the pipe portion, thereby reducing a viscosity of a mud cake external to the pipe portion and/or increasing a pressure external to the pipe portion to allow the pipe to be retrieved from the well, and wherein the tool comprises an azimuthal orientation device to align the tool with the axial and azimuthal location of the pipe portion.

11. The system of claim 10, wherein a laser is positioned in the tool.

12. The system of claim 10, further comprising a laser positioned remote from the tool, the beam of light configured to be transmitted from the laser to the tool via an optical waveguide.

13. The system of claim 10, wherein the pipe portion is embedded in the mud cake lining the wellbore.

14. The system of claim 13, wherein the beam of light is configured to at least partially penetrate the mud cake.

15. The system of claim 10, wherein the tool further comprises seals that are configured to straddle the axial and azimuthal location of the pipe portion.

16. The system of claim 15, wherein the tool is configured to purge well fluid from radially between the tool and the axial and azimuthal location of the pipe portion and from longitudinally between the seals.

17. A method of freeing a pipe stuck in a subterranean well, the method comprising:

determining an axial and azimuthal location of a portion of the pipe that is biased against a wall of a wellbore by differential pressure;

azimuthally and axially aligning a tool with the axial and azimuthal location of the pipe portion; and directing a beam of light to the axial and azimuthal location of the pipe portion, thereby reducing a viscosity of a mud cake external to the pipe portion and/or increasing a pressure external to the pipe portion to allow the pipe to be retrieved from the well.

18. The method of claim 17, wherein the determining further comprises determining the axial and azimuthal location at which the portion of the pipe is stuck in the wellbore.

19. The method of claim 17, wherein the determining further comprises transmitting an acoustic signal to the pipe.

20. The method of claim 17, wherein the directing further comprises producing the beam of light from a laser.

21. The method of claim 20, further comprising positioning the laser in the tool, and deploying the tool into the pipe.

22. The method of claim 20, further comprising transmitting the beam of light from the laser and into the pipe via an optical waveguide.

23. The method of claim 17, wherein the pipe portion is embedded in the mud cake lining the wellbore.

24. The method of claim 23, wherein the directing further comprises cutting into the mud cake.

25. The method of claim 17, wherein the directing further comprises emitting the beam of light from the tool positioned in the well, after purging well fluid from between the tool and the pipe portion.

26. The method of claim 17, wherein the directing further comprises penetrating a sidewall of the pipe portion with the beam of light at the axial and azimuthal location of the pipe portion.

27. The method of claim 17, wherein the directing further comprises heating a sidewall of the pipe portion with the beam of light at the axial and azimuthal location of the pipe portion.

28. A system for freeing a pipe stuck in a subterranean well, the system comprising:

a tool configured to be deployed into an axial and azimuthal location of a portion of the pipe stuck in the well by a differential pressure from a wellbore to a formation penetrated by the wellbore, wherein the tool is configured to emit a beam of light from the tool to heat the axial and azimuthal location of the pipe portion, thereby reducing a viscosity of a mud cake external to the pipe portion and/or increasing a pressure external to the pipe portion to allow the pipe to be retrieved from the well, and wherein the tool comprises an azimuthal orientation device to align the tool with the axial and azimuthal location of the pipe portion.

29. The system of claim 28, wherein a laser is positioned in the tool.

30. The system of claim 28, further comprising a laser positioned remote from the tool, the beam of light configured to be transmitted from the laser to the tool via an optical waveguide.

31. The system of claim 28, wherein the axial and azimuthal location of the pipe portion is embedded in the mud cake lining the wellbore.

32. The system of claim 28, wherein the tool further comprises seals that are configured to straddle the axial and azimuthal location of the pipe portion.

33. The system of claim 32, wherein the tool is configured to purge well fluid from radially between the tool and the pipe portion and from longitudinally between the seals.

* * * * *